US006001072A

United States Patent [19]

Fujiwara

[11] Patent Number: 6,001,072

[45] Date of Patent: Dec. 14, 1999

[54] APPARATUS FOR IMPARTING ACOUSTIC VIBRATIONAL BODILY SENSATION

[76] Inventor: Kazumichi Fujiwara, Room 202, Yukikan, 14-10, Mita 2-chome Meguro-ku, Tokyo 153, Japan

[21] Appl. No.: 08/602,865

[22] PCT Filed: Jun. 30, 1995

[86] PCT No.: PCT/JP95/01303

§ 371 Date: Feb. 28, 1996

§ 102(e) Date: Feb. 28, 1996

[87] PCT Pub. No.: WO96/01031

PCT Pub. Date: Jan. 11, 1996

[30] Foreign Application Priority Data

Jun. 30, 1994 [JP] Japan ..... 6/171783

[51] Int. Cl.[6] ..... A61H 1/00

[52] U.S. Cl. ..... 601/47; 601/46; 601/80

[58] Field of Search ..... 601/46, 47, 48, 601/49–54, 58, 67–69, 70, 72, 80–82, 120; 434/114, 112, 116; 446/484, 236

[56] References Cited

U.S. PATENT DOCUMENTS

| | | | |
|---|---|---|---|
| Re. 32,785 | 11/1988 | Hirano | 601/47 |
| 2,661,736 | 12/1953 | Schwartz | 601/46 |
| 2,830,578 | 4/1958 | Groff | 601/47 |
| 4,175,552 | 11/1979 | Johnson | 601/46 |
| 4,187,837 | 2/1980 | Braun | 601/46 |
| 4,310,315 | 1/1982 | Frank et al. | 434/114 |
| 4,728,934 | 3/1988 | Pfander et al. | 434/112 |
| 4,905,001 | 2/1990 | Penner | 434/114 |
| 4,989,613 | 2/1991 | Finkenberg | 600/552 |
| 5,388,992 | 2/1995 | Franklin et al. | 434/114 |
| 5,442,710 | 8/1995 | Komatsu | 601/47 |
| 5,458,119 | 10/1995 | Vanharanta | 601/46 |

FOREIGN PATENT DOCUMENTS

| | | | |
|---|---|---|---|
| 251430 | 1/1988 | European Pat. Off. | 601/47 |
| 52-103910 | of 1977 | Japan . | |
| 52-75430 | of 1977 | Japan . | |
| 57-171371 | of 1982 | Japan . | |
| 63-18129 | 2/1988 | Japan . | |
| 63-309093 | 12/1988 | Japan . | |
| 5-14996 | of 1993 | Japan . | |
| 5-14996 | 1/1993 | Japan . | |
| 405300943 | 11/1993 | Japan | 601/46 |
| 5-300943 | 11/1993 | Japan . | |

OTHER PUBLICATIONS

Japanese language International Search Report.

*Primary Examiner*—Richard J. Apley
*Assistant Examiner*—Justine R. Yu
*Attorney, Agent, or Firm*—Smith, Gambrell & Russell

[57] ABSTRACT

A method and an apparatus for imparting the bodily sensation of acoustic vibrations. An electric signal of a player 203 is branched and supplied to speakers 201 and 202 or an earphone 210 and to an electric machine vibration converter 100. The sound from the speakers 201 and 202 or the earphone 210 and the vibration of the electric machine vibration converter 100 are applied audibly to the human body 100 and sensibly as the bodily sensation to the human body, respectively. When in use, a convex curved surface of an extension 101 provided on the electric machine vibration converter 100 is pinched so as to be strongly pushed between the fingertip 301 of the thumb and the forefinger. Since the vibration is transmitted to the fingertip, it is possible to realize the most effective impartment of the bodily sensation.

9 Claims, 7 Drawing Sheets

FIG. 5(a)
[CIRCUIT CONFIGURATION VIEW]
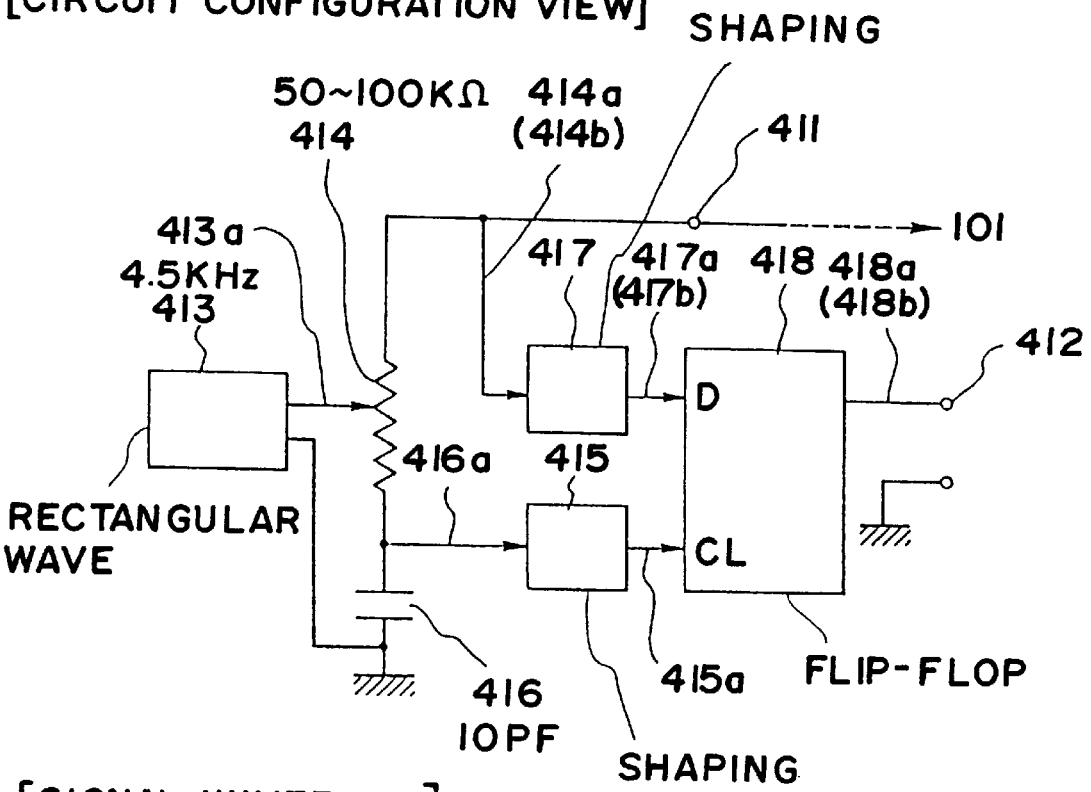
[SIGNAL WAVEFORM]
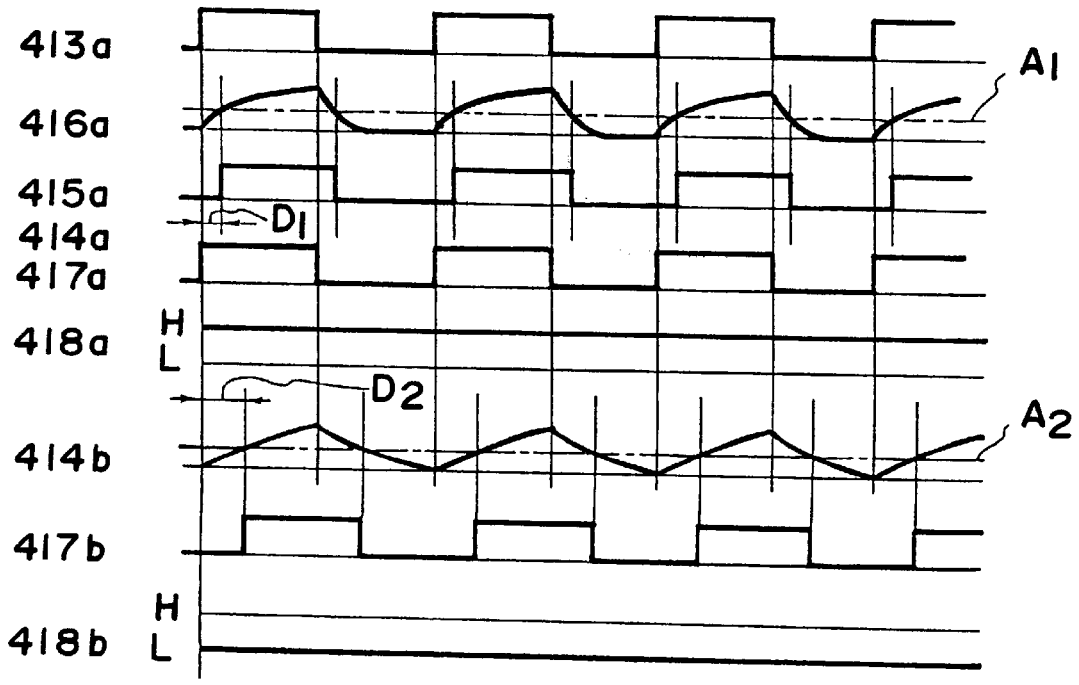
FIG. 5(b)

APPARATUS FOR IMPARTING ACOUSTIC VIBRATIONAL BODILY SENSATION

TECHNICAL FIELD

This invention relates to a method of the acoustic vibrational bodily sensation for imparting vibrations (in this invention, referred to as "imparting bodily sensation") obtained by an electric machine vibration converter in response to an electric signal having an acoustic frequency, as responsive effect to the human body through the skin, a bone or the like without the auditory sense, and an apparatus therefor. Particularly, this invention provides a configuration in which vibrations are transmitted to a fingertip which is sensitive in feeling to thereby increase the bodily sensation to be imparted.

BACKGROUND ART

The conventional method for imparting the acoustic vibrational bodily sensation and apparatus therefor as described above has its main object that while enjoying the music with the auditory sense, rhythmic sense caused by the music is tasted with the bodily sensation to thereby further increase the pleasant sensation caused by the music. A further object thereof is to let a deaf and dumb person learn an intonation in conversational utterance.

Further, the electric machine vibration converter 100 includes a speaker of the voice coil type as shown in FIG. 8 (hereinafter referred to as the first prior art) and disclosed in Japanese Utility Model Laid-Open Publication No. 75430/1977, and or a solenoid actuator type as shown in FIG. 9 (hereinafter referred to as the second prior art) and disclosed in Japanese Utility Model Laid-Open Publication No. 171371/1982.

In FIG. 8, a cylindrical movable coil 51 is arranged to be freely moved in and out of a gap 54 whose section is in the form of a slot and whose plane is annularly provided within a field system 53 magnetized by a permanent magnet 52. A vibrator 55 secured to the movable coil 51 is held on the side of the field system 53 through an elastic holding plate 56. With this configuration, an electric signal having an acoustic frequency is applied to the movable coil 51 so that the movable coil 51 may be mechanically vibrated in response to the frequency and amplitude of the electric signal and a vibration source is obtained from relative vibrations between the field system 53 and the vibrator 55.

The constitution shown in FIG. 8 is called the speaker voice coil type since the mode of arrangement of the movable coil 51 and the field system 53 corresponds to that of a voice coil in a speaker and a field yoke.

In FIG. 9, an exciting coil 61 is embedded into a field system 62, and an elastic vibrator 63 is arranged opposite to the side of a release end of the field system 62 and held on the side of the field system 62 through an elastic holding plate 64. With this configuration, an electric signal having an acoustic frequency is applied to the exciting coil 61 so that the vibrator 63 may be mechanically vibrated in response to the frequency and amplitude of the electric signal and a vibration source is obtained from relative vibrations between the field system 62 and the vibrator 63.

As the an agrangement; and in which the movable side and the fixed side in the constitution shown in FIG. 9 are reversed, Japanese Patent Laid-Open Publication No. 14996/1993 discloses a device (hereinafter referred to as the third prior art) in which the vibrator 63 as a permanent magnet is arranged on the fixed side, and the exciting coil 61 and a magnetic core for a field 62 are held by the elastic holding plate and arranged on the movable side.

The constitution shown in FIG. 9 is called the solenoid actuator type since the arrangement is one in which the vibrator is attracted and deenergized by the magnetic force produced by the exciting coil 61 and the field system corresponds to that of a solenoid field system and an actuator in the solenoid actuator.

On the other hand, as the an arrangement for imparting the bodily sensation, there is proposed a constitution (hereinafter referred to as the fourth prior art) in which a contact portion provided in the vibrator 63 is laid on a body bone portion —;—; such as an ear bone —;—, to impart the bodily sensation. Further, Japanese Patent Laid-Open Publication No. 300943/1993 discloses a device (hereinafter referred to as the fifth prior art) in which —;—; as shown in FIG. 10, the hemispherical shells 73 and 74 are mounted on each of the outer sides of a field system side 71 and a vibrator side 72 secured to the movable coil which are a modification of the constitution of the aforementioned first prior art, the outer surfaces of both the shells being embraced by the palms 75 and 76 of both hands to impart the bodily sensation through the palms.

Further, Japanese Utility Model Laid-Open Publication No. 103910/1977 and Japanese Patent Laid-Open Publication No. 14996/1993 disclose a devices (hereinafter referred to as the sixth prior art) in which the bodily sensation is imparted from the hip or the sole of a foot of the human body by the electric machine vibration converter 100A, 100B, or 100C described in the above-described first, third and fourth prior arts.

In the bodily sensation imparting method according to the above-described fourth prior art, the auditory sensation by the auditory sense and bodily sensation by the vibration are received at the same part of the human body. This poses an inconvenience in that the auditor and bodily sensation become confused making it difficult to obtain a pleasant sensation as intended.

Further, it is necessary for imparting to stronger bodily sensation by the above-described prior arts 5 and 6 to increase electric power of the electric signal supplied to the electric machine vibration converter. By doing so, however, not only must the apparatus becomes larger in size but also the vibration of the electric machine vibration converter become stronger so that vibrational sounds directly produced from the electric machine vibration converter itself or from a chair or a floor on which the electric machine vibration converter is mounted increase, resulting in an inconvenience that the vibrational sound turns into the noise so as to conversely impart the unpleasant sensation in terms of the auditory sense.

Therefore, there gives rise to a problem in that the provision of a method and an apparatus for imparting the bodily sensation without being attended with these inconveniences as noted above is desired.

DISCLOSURE OF THE INVENTION

The aforementioned problem is solved by the present invention which provides a method for imparting a strong bodily sensation by directly transmitting a vibration obtained from the electric machine vibration converter itself or an extension provided on the electric machine vibration converter to a fingertip of the human body, and an apparatus using the above method and in addition, a constitution in which via a switch device which —;—; is operated to be switched by contact and noncontact with a hand of the human body relative to the aforesaid extension, an electric signal is supplied to the electric machine vibration converter only when the hand comes in contact therewith.

The feeling of the fingertip in the human body is more sensitive than that of the hip, the sole, and the palm with respect to the bodily sensation. Since the vibration is directly transmitted to the sensitive fingertip in the present invention, it may be operated so that even if the power of the electric signal is relatively small, a sufficiently strong bodily sensation can be imparted. In many cases, this operation is more effective when a vibration is transmitted to a fingertip of a left hand.

Further, since the electric power of the electric signal can be minimized, it is operated so that vibrational sounds directly produced from the electric machine vibration converter itself or a chair or a floor on which the electric machine vibration converter is mounted are eliminated or lowered so as to reduce the unpleasant sensation caused by the vibrational sounds.

Furthermore, since the electric signal is supplied to the electric machine vibration converter only when a hand of the human body is in contact with the extension of the electric machine vibration converter, it is operated so that —;—; when not in the operation for imparting the bodily sensation, noises caused by vibrations of structures in the vicinity of a place where the electric machine vibration converter is mounted are prevented from being produced.

BRIEF DESCRIPTION OF THE DRAWINGS

FIGS. 1 to 7 show various embodiments of this invention.

FIG. 1 is an explanatory view of a system for imparting the acoustic vibrational bodily sensation according to this invention.

FIG. 2 is a perspective view showing parts of am embodiment a method for imparting the acoustic vibrational bodily sensation.

FIG. 3 is a longitudinal sectional view showing an embodiment of an apparatus for imparting the acoustic vibrational bodily sensation (hereinafter merely referred to as the apparatus).

FIG. 4 is a block diagram of a circuit configuration for the apparatus.

FIGS. 5(a) and 5(b) are views showing a circuit configuration for the apparatus and a signal waveform view in comparison.

FIG. 6 is a longitudinal sectional view of the another embodiment of the invention.

FIG. 7 is a longitudinal sectional view of the out a second modification.

BEST MODE FOR CARRYING OUT THE INVENTION

Figure 1:
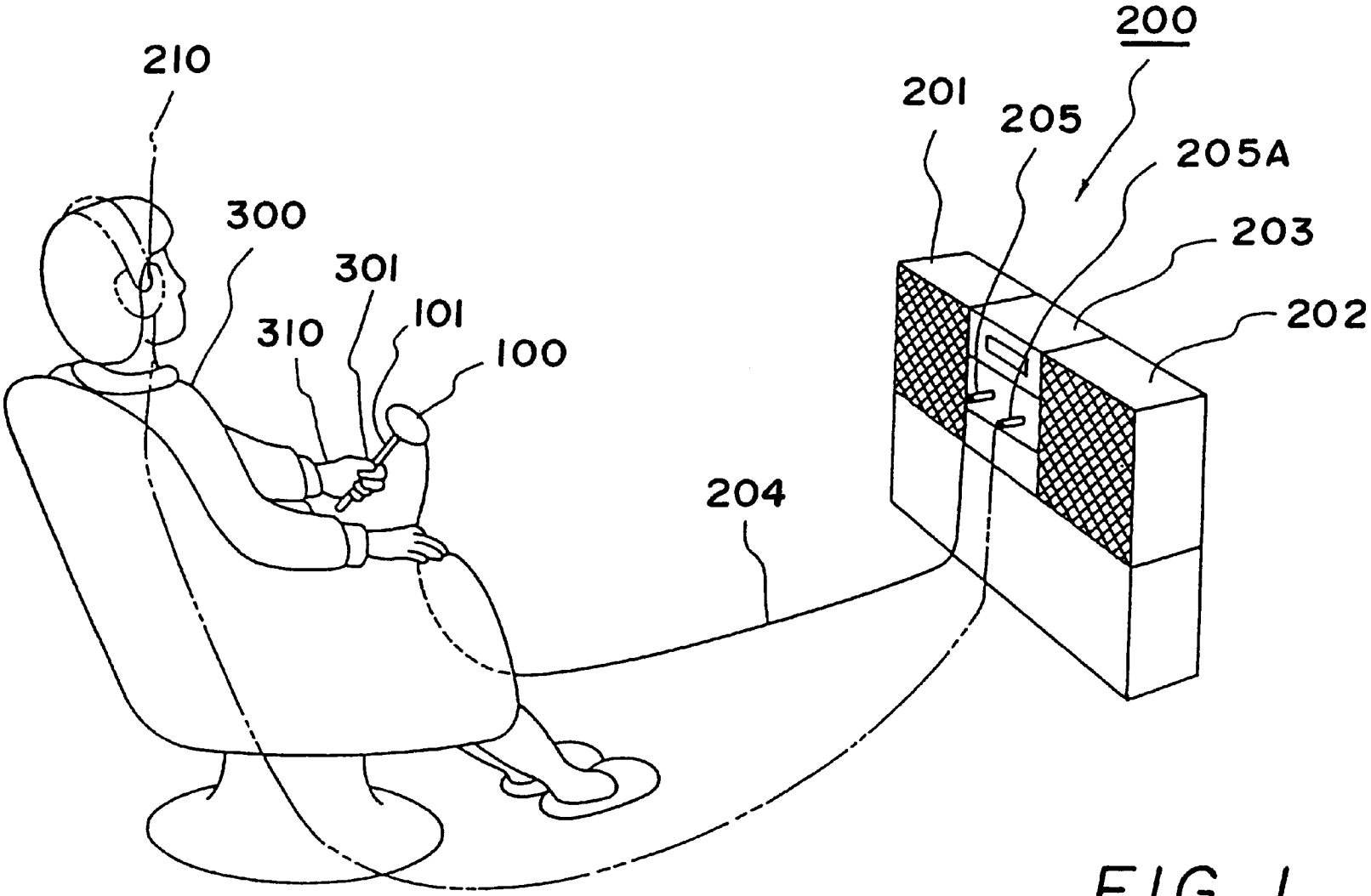

The best mode for carrying out this invention will be explained hereinafter with reference to FIGS. 1 to 5(b). It is to be noted that in FIGS. 1 to 5(b), the elements indicated by the same reference numerals as those in FIGS. 8 to 10 have the same function as the elements indicated by the same reference already explained in connection with FIGS. 8 to 10.

MODE FOR CARRYING OUT THE METHOD

First, the mode for carrying out the method will be explained with reference to FIGS. 1 and 2. In FIG. 1, a stereo-audio set 200 is a commercially available stereo-audio set provided with left and right speakers 201 and 202, and a player 203, for example, a CD (Compact Disk) player, in which a sound, for example, a music sound of a musical performance is provided in an attempt to appeal the auditory sensation of the human body 300 from the speakers 201 and 202.

A lead wire 204 supplies an electric signal having an acoustic frequency from an output terminal 205 of an amplification circuit of the player 203 to an electric machine vibration converter 100. The vibration produced by the electric machine vibration converter 100 is transmitted through an extension 101 mounted on the electric machine vibration converter 100 to a fingertip 301 of a left hand of the human body 300 to thereby impart the bodily sensation caused by the vibration corresponding to the music sound to the human body 300.

The constitution according to the carrying-out mode shown in FIG. 1 may be summarized as follows. In the method for allowing the vibration obtained by supplying the electric signal having the acoustic frequency to the electric machine vibration converter 100 to be bodily sensed, there is constituted a method for imparting the acoustic vibrational bodily sensation which method imparts the bodily sensation by directly transmitting a vibration obtained from an extension 101 mounted on the electric machine vibration converter 100 to a fingertip 301 of the human body 300 to thereby impart the bodily sensation.

Figure 2:
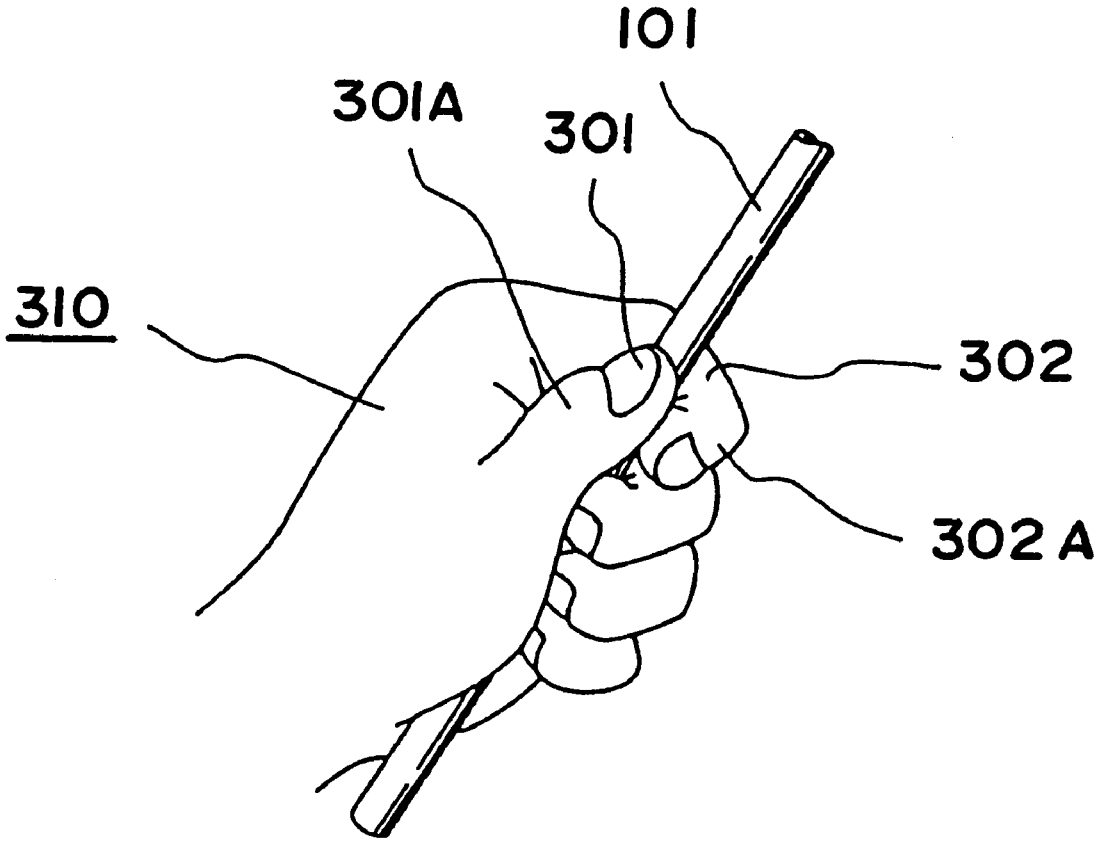

FIG. 2 shows a portion of a hand 310 of the human body 300. The extension 101 is formed, for example, from an aluminum round pipe or an aluminum round rod and is in the form of a pole having a smaller section than that of the thumb 301A of the hand 310 of the human body 300.

The extension 101 is sandwiched between the fingertip 301 portion of the thumb 301A and a second joint portion 302 of the forefinger 302A, namely, a portion located between a first joint and a second joint and held while strongly pressing it with the fingertip 301 of the thumb 301A whereby the vibration of the electric machine vibration converter 100 is directly transmitted to the fingertip 301 of the thumb 301A and the second joint portion 302 of the forefinger 302A. In this holding state, a nerve is concentrated in the fingertip 301 of the thumb 301A and the second joint portion of the forefinger 302A. Therefore, the bodily sensation can be sensed sharply.

The constitution according to the the embodiment shown in FIGS. 1 and 2 may be summarized as follows. There is a method for imparting the acoustic vibrational bodily sensation in which the vibration of the electric machine vibration converter 100 is directly transmitted to the fingertip 301 of the thumb 301A and the second joint portion 302 of the forefinger 302A to thereby impart the bodily to sensation further method for imparting the acoustic vibrational bodily sensation in which the vibration is directly transmitted to the fingertip by the extension 101 formed of to be solid and in the form of a pole having a smaller section than that of the thumb 301A of the human body 300.

MODE FOR CARRYING OUT THE APPARATUS

The best mode for carrying out the invention will be explained hereinafter with reference to FIGS. 3 to 5(b). It is to be noted that in FIGS. 3 to 5(b), the elements indicated by the same reference numerals as those in FIGS. 1 and 2 have the same function as that of the elements already explained in connection with FIGS. 1 and 2.

Figure 3:
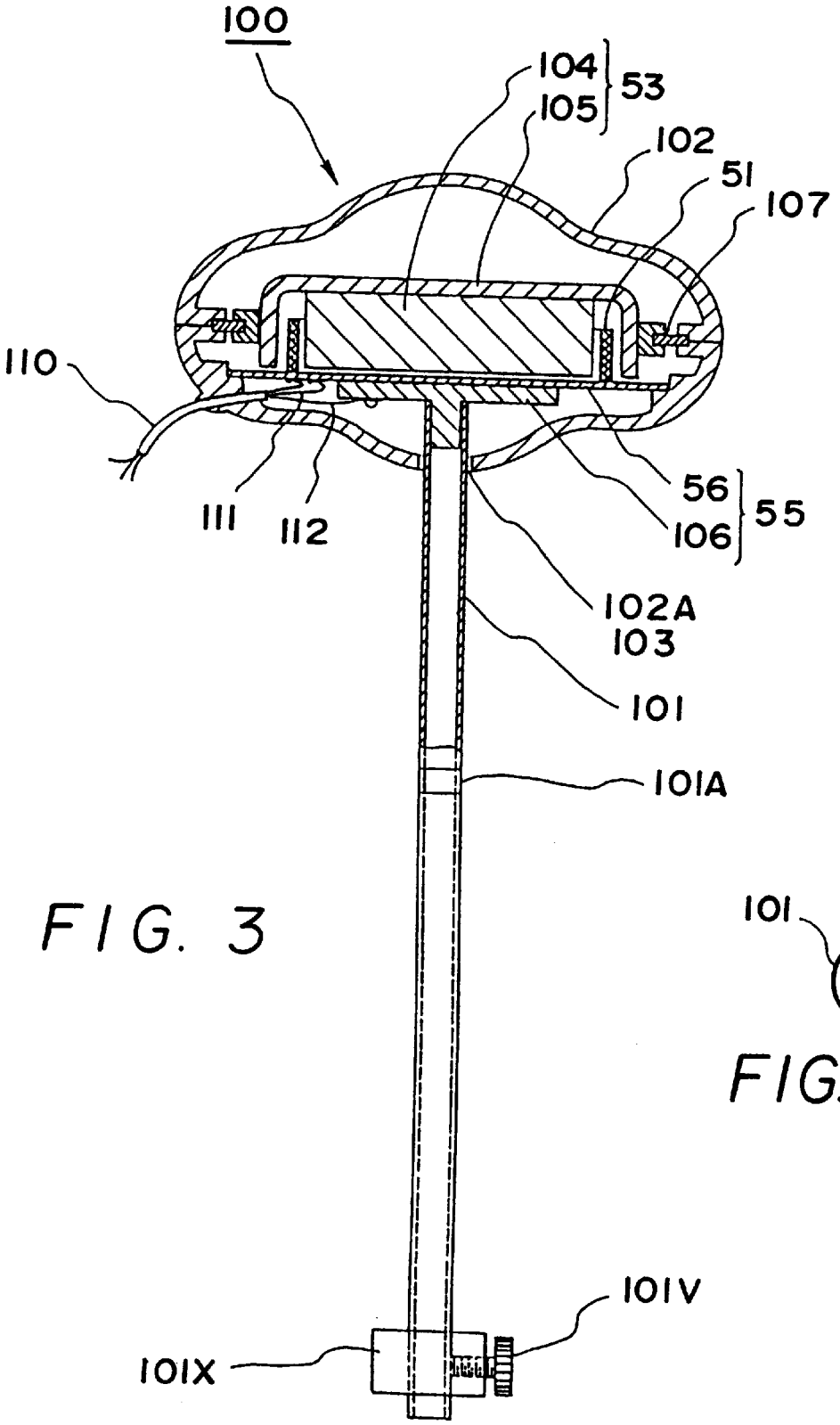

In a sectional view of FIG. 3, the electric machine vibration converter 100 is of the speaker voice type similar to the first prior art, which is wholly encased in an enclosure 102. In each of portions other than a portion of a clearance 103 between a through-hole 102A and an outside diameter of an extension 101, contacting parts in the figure are all fixed and integrated with adhesives, and all the portions are circular in shape as viewed in plane.

A permanent magnet 104 and a yoke 105 constitute a field system 53. The yoke 105 is secured within the enclosure 102 through a metal plate, for example, a spring plate 107 in the form of a thin stainless steel plate subjected to bluing.

A movable coil 51 is secured to a holding plate 56 formed from a thin synthetic resin plate serving as a vibrational plate, for example, a thin plate formed of FRP, that is, a fibrous glass reinforced plastic. The holding plate 56 and a spacer 106 secured to the holding plate constitute a vibrator 55.

The spacer 106 is formed of metal, for example, aluminum. The extension 101 provided on the electric machine vibration converter 100 is secured to the spacer 106 to thereby transmit the vibrational energy on the movable coil 51 side which vibrates relative to the mass on the side of the field system 53 including the enclosure 102.

The extension 101 is in the form of a pole whose outside diameter has a smaller section than that of the thumb 301A of the human body 300. The pole is preferably, for example, a metal pipe or a metal rod having a diameter of 1 cm or less, for example, an aluminum round pipe having a 0.8 cm of diameter and 20 cm or more in length, or a pole-like configuration. The extension 101 is applied with a predetermined mark 101A for indicating a place on which the tip 301 of the thumb 301A is put, for example, a web-like coating or a tape. The outer convex curved surface of the extension 101 is pressed against the finger tip 301, as shown in FIG. 2, to thereby impart the vibrational bodily sensation to the human body 300.

For the place applied with the mark 101A, it is preferable to select a place where the vibration transmitted to the fingertip 301 is strongest at a predetermined frequency, for example, 150 Hz. In many cases, for such a place as described above, it is suitable for selecting a position of the "belly" of the vibration on the extension 101 at a desired frequency.

A cable 110 includes a lead wire 111 for supplying an acoustic electric signal to the electric machine vibration converter 100 and a lead wire 112 for detecting the contact and noncontact of a hand 310 of the human body 300 relative to the extension 101. The lead wire 111 is connected to the movable coil 51 whereas the lead wire 112 is fixed on the spacer 106 and electrically connected to the extension 101 through the spacer 106. A further lead wire to the movable coil 51, is used as a conductor on the earth side, i.e., the shield side of the cable 110. The lead wire 111 corresponds to a lead wire 204 shown in FIG. 1.

The enclosure 102 is formed of synthetic resin, for example, a fibrous glass reinforced plastic, and is divided into two upper and lower sections at the place of the spring plate 107, in which the electric machine vibration converter 100 is mounted on the lower portion after which the upper portion is laid thereon and secured so that these two portions are integrated.

Figure 4:
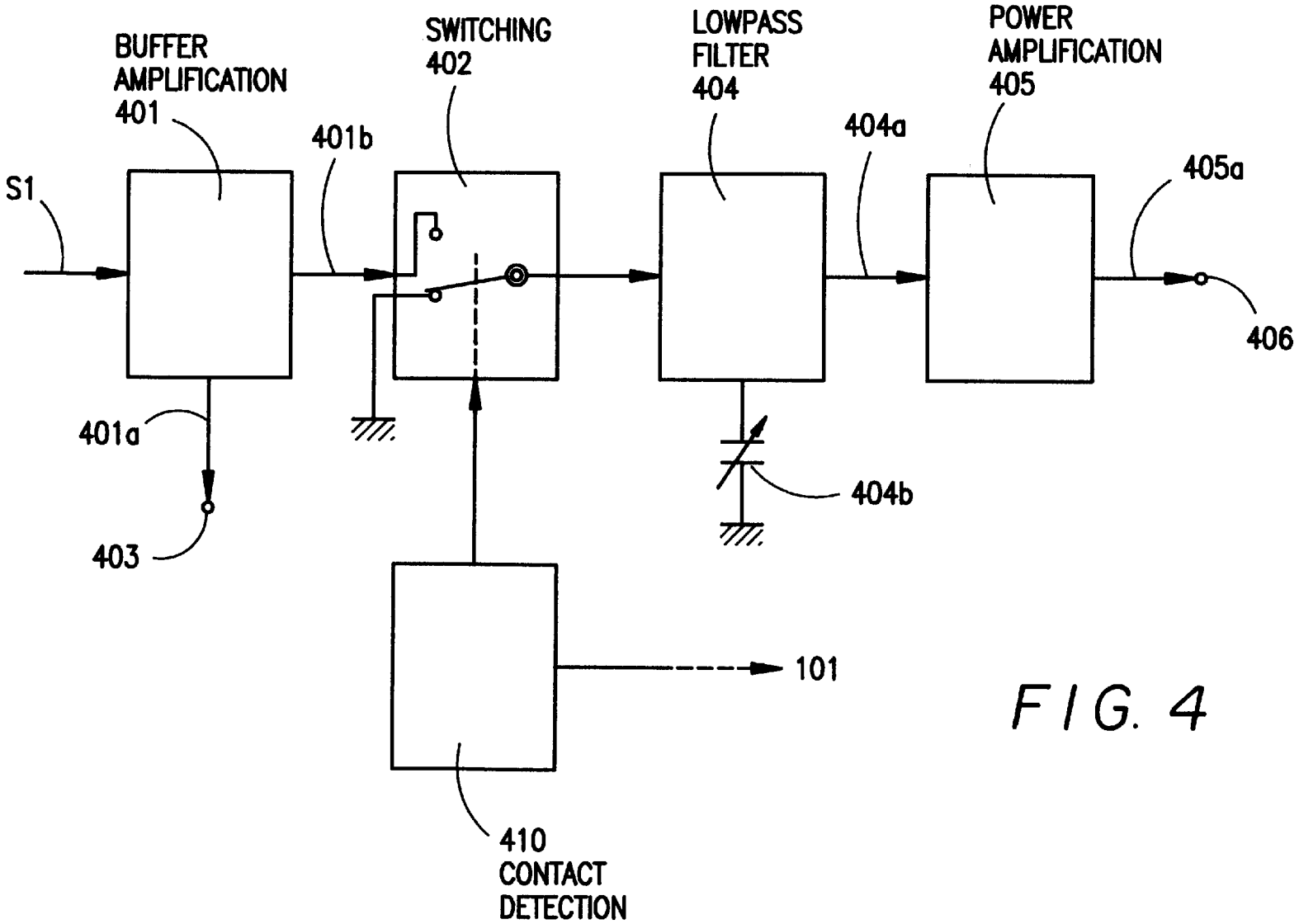

In FIG. 4, an acoustic frequency signal S1 is an electric signal obtained in a manner that a musical sound signal having a frequency of the musical sound for example, an electric signal obtained from a CD player —,—; is amplified by an amplification circuit as required. An electric signal 401*a* for the auditory sensation amplified by an amplification circuit 401 for a buffer and a branch signal 401*b* thereof are supplied to a switching circuit 402 and an output terminal 403 for the auditory sensation, respectively, in response to the acoustic frequency signal S1. The output terminal 403 for the auditory sensation is provided to supply an output signal to electric acoustic converters such as the speakers 201 and 202 or the headphone 210 shown in FIG. 1. The auditory sensation is imparted to the human body through the acoustic sense by sounds produced from these electric acoustic converters.

The switching circuit 402 is connected to be switched so that, when a contact detection circuit 410 —(—; explained later with reference to FIG. 5(a)—)—; detects that the hand 101 of the human body 300 is in contact with the extension 101, the branch signal 401*b* is supplied to a succeeding lowpass filtration circuit 404—,—. whereas when the contact detection circuit 410 detects that the hand 101 of the human body 300 is not in contact with the extension 101, the branch signal 401*b* is not supplied to the lowpass filtration circuit 404. The switching circuit 402 is, for example, a switching circuit by way of a relay or transistors. When the branch signal 401*b* is not supplied to the lowpass filtration circuit 404, an input terminal of the lowpass filtration circuit 404 is connected to the earth so as not to be an open impedance circuit.

The lowpass filtration circuit 404 supplies, to a succeeding power amplification circuit 405, a signal 404*a* for the bodily sensation obtained by the filtration such that only a frequency as in on the lowpass band suitable —,—; for imparting the bodily sensation to the human being 300, out of frequency components contained in the branch signal 401*b*, —(—; for example, only a frequency of 300 Hz or less —)—; is allowed to pass. Further, as necessary, an element for changing a filtration frequency, for example, a variable capacitor 404*b* is —,—; so as to be able to change the filtration frequency, or the branch signal 401*b* is output as the signal 404*a* for the bodily sensation with the frequency without modification.

The power amplification circuit 405 amplifies the signal 404*a* for the bodily sensation to a signal output 405*a* of an amplitude suitable for imparting the bodily sensation as required to the fingertip 301 of the human body 300 by the electric machine vibration converter 100 shown in FIG. 3 —,—; to output the signal 404*a* via an output terminal 406 for the bodily sensation.

The output terminal 406 for the bodily sensation corresponds to the output terminal 205 shown in FIG. 1, and is a terminal to be connected to the movable coil 51 through the lead wire 111 of the cable 110 of the electric machine vibration converter 100 shown in FIG. 3. As the lead wire on the earth side, a conductor on the shield side of the cable 110 is used.

It is to be noted that in FIG. 5(b), the elements indicated by the same reference numerals as those in FIG. 4 have the same function as the elements indicated by the same reference numerals already explained in connection with FIG. 4.

In FIGS. 5(a) and 5(b), with respect to the contact detection circuit 4 shown in FIG. 4, the upper half portion of FIG. 5(a) shows a circuit for detecting that a circuit constant is changed by the electrostatic capacity of the human being 300, that is, a detection circuit operated by a body effect.

In the [circuit configurational view] shown in FIG. 5(a), a terminal 411 is a terminal to be connected to the extension 101 through the lead wire 112 shown in FIG. 3. Further, a terminal 412 is a terminal for applying a switching input to the switching circuit 402 shown in FIG. 4. Operating signals in various parts in the circuit are as shown in the [signal waveform view; shown FIG. 5(b).

A rectangular wave generation circuit 413 applies a rectangular wave signal 413*a* to a variable terminal of a variable resistor 414. One terminal of the variable resistor 414 is connected to a clock input terminal CL of a flip-flop circuit 418 via a first waveform shaping circuit 415 and is branched in the middle and also connected to the earth side via a capacitor 416. The other terminal of the variable resistor 414 is connected to a data input terminal D of the flip-flop circuit 418 via a second waveform shaping circuit 417 and is branched in the middle and also connected to the input terminal 411. And, an ordinary phase output terminal of the flip-flop circuit 418 is connected to the output terminal 412.

With the above configuration, when the hand 301 of the human body 300 is not in contact with the extension 101 connected to the input terminal 411, an output 417*a* of the second waveform shaping circuit 417 is in the same phase as the rectangular wave signal 413*a* without a delay. On the other hand, an input 416*a* to the first waveform shaping circuit 415 is integrated by a time constant determined mainly by the resistance value at the lower side in the figure than the variable terminal in its position of the variable resistor 414 and the electrostatic capacity of the capacitor 416. Therefore, when the waveform is shaped by the first waveform shaping circuit 415 with a predetermined level Al being a threshold, a signal appears which always has a phase delay D1 of a given value —,—; relative to the rectangular wave signal 413*a* —,—, as a reference waveform output 415*a*. As a result, the output of the flip-flop circuit 418 is maintained at an H level output 418*a*.

When the output of the flip-flop circuit 418 is maintained at an H level output 418*a*, the hand 301 of the human body 300 is not in contact with the extension 101. Therefore, the switching circuit 402 responds to the H level output and is switched to the state in which the branch signal 401*b* is not supplied to the lowpass filtration circuit 404. Accordingly, the signal output 405*a* is not supplied to the electric machine vibration converter 100.

When the hand 301 of the human body 300 is in contact with the extension 101 connected to the input terminal 411, the electrostatic capacity of the human body 300 becomes connected. Thus, the input 414*a* to the second waveform shaping circuit 417 is integrated by a relatively large time constant determined mainly from the resistance value at the upper side in the figure than the variable terminal of the variable resistor 414 and the electrostatic capacity of the human body so as to be the signal 414*b*. Therefore, when the waveform is shaped by the second waveform shaping circuit 417 with a predetermined level A2 being a threshold, a signal appears which has a phase delay by D2-D1 relative to the reference waveform output 415*a*. At the clock time at which the clock input terminal CL of the flip-flop circuit 418 is inverted from a L level to a H level, the data input terminal D is maintained at the L level whereby the output of the flip-flop circuit 418 is inverted to the L level output 418*b* and maintained thereat.

When the output of the flip-flop circuit 418 is at the L level output 418*b*, the hand 301 of the human body 300 is in contact with the extension 101. Thus, the switching circuit 402 responds to the L level output and is connected to be switched to the state in which the branch signal 401*b* is supplied to the lowpass filtration circuit 404. Accordingly, the signal output 405*a* is supplied to the electric machine vibration converter 100.

The position of the variable terminal of the variable resistor 414, the level A1 and the level A2 can be adequately adjusted so that the aforementioned function is suitably attained by the phase delay D1 and the phase delay D2

The constitution of the this embodiment excluding the portion of the invention shown in FIG. 5(a), i.e., from FIGS. 3 to 4, may be summarized as follows. In an apparatus in which a vibration is obtained by supplying the electric signal 405*a* having an acoustic frequency to the electric machine vibration converter 100, the extension 101 is provided on the electric machine vibration converter 100 with a convex curved surface against which the fingertip 301 of the human body 300 may be directly pressed, for example, a convex curved surface external of a round pipe.

The constitution of the this embodiment of the invention according to FIGS. 3 to 5(a) may be summarized as follows. First, there is an apparatus for imparting the acoustic vibrational bodily sensation in which extension 101 shown in FIG. 3, the is formed of a solid piece having a diameter of 1 cm or less and a length of 20 cm or more, for example, a pole-like member in the form of an aluminum round pipe, said pole-like member having an outer surface in the form of a convex curved surface. Secondly, there is an apparatus for imparting the acoustic vibrational bodily sensation in which —,—, in the switching circuit 402 and the contact detection circuit 410 shown in FIGS. 4 and 5(a), the electric signal 405*a* is supplied to the electric machine vibration converter 100 only when the hand 310 is in contact to be switched according to the contact and noncontact of the hand with the extension 101. Thirdly, there is an apparatus for imparting the acoustic vibrational bodily sensation in which —,—, as with the mark 101A shown in FIG. 3, a predetermined mark 101A is applied to the place where the vibration is strongest transmitted to the fingertip 301.

BEST MODE FOR CARRYING OUT MODIFICATION

This invention includes the mode for carrying out the following modifications.

Figure 6:
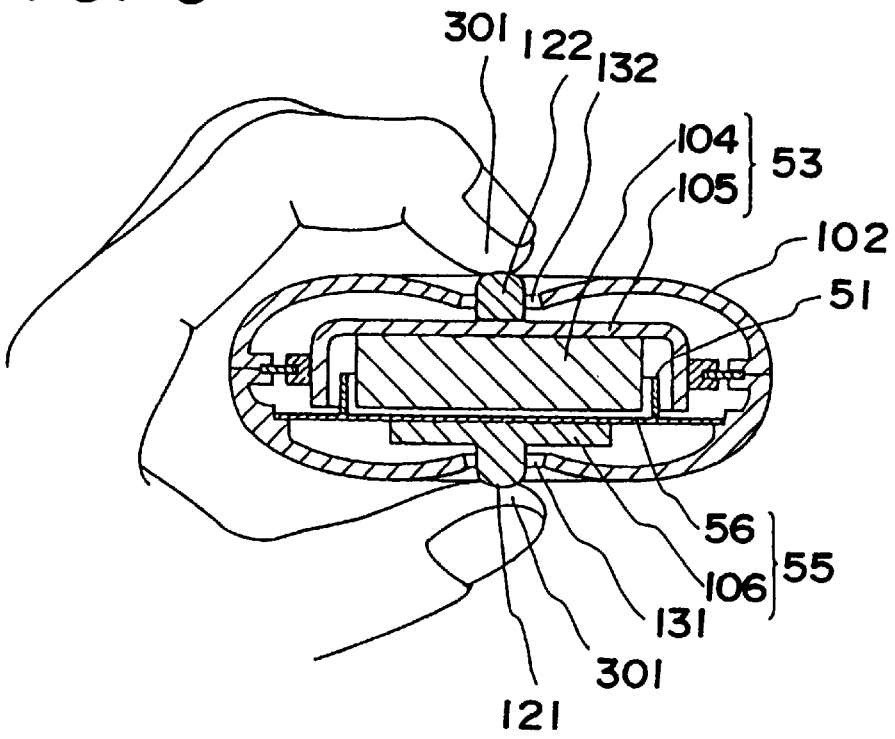

(1) The enclosure 102 of the electric machine vibration converter 100 is arranged such that —,—; as shown in FIG. 6, a central portion is shaped to be depressed, holes 131 and 132 are provided in central portions of both surfaces, a protrusion 121 having an extreme end rounded in a central portion of the spacer 106, and a protrusion 122 is also provided in a central portion of a yoke 105 laid on the back thereof. The two protrusions 121 and 122 are held by two fingertips, for example, the fingertip of the thumb and the fingertip of the middle finger and directly pressed against the fingertips so as to obtain the bodily sensation.

Figure 7:
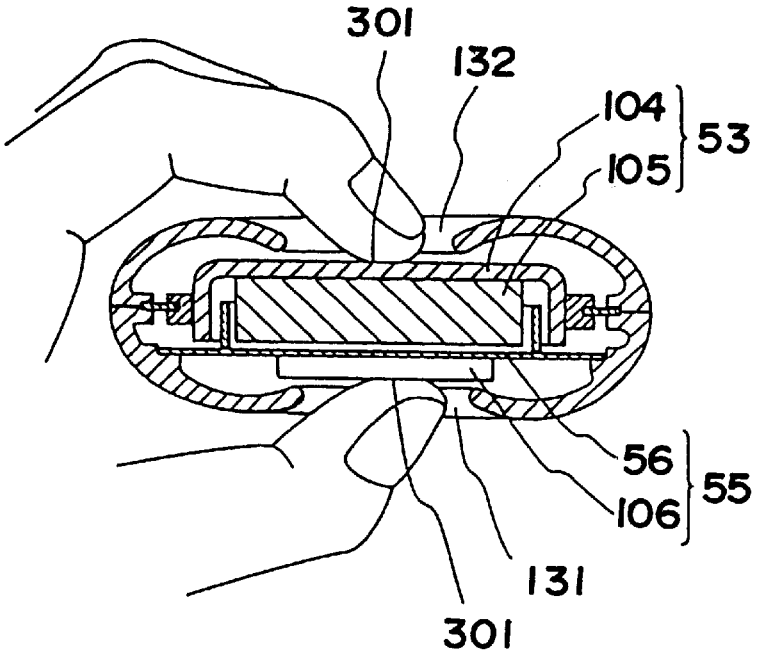

(2) The enclosure 102 of the electric machine vibration converter 100 is constituted such that —,—. as shown in FIG. 7, a central portion is shaped to be depressed, holes 131 and 132 are provided in central portions of both surfaces, an outer surface of the spacer 106 is formed into a plane, and the outer surface of the spacer 106 and the outer surface of the yoke 105 are held by two fingertips, for example, the fingertip of the thumb and the fingertip of the middle finger and directly pressed against the fingertips so as to obtain the bodily sensation.

(3) In the constitutions described in the above (1) and (2), the body effect by the contact between the spacer 106 and the fingertip, in place of the contact between the extension

101 and the hand 310 in the contact detection circuit 410, is utilized to carry out the contact detection.

(4) The extension 101 is formed from a solid piece other than metal, for example, a round pipe or a pole-like member in the form of a round rod made of hard synthetic resin.

(5) The switching operation of the switching circuit 402 is carried out, not by the contact detection circuit 410, but by depressing a microswitch provided in the midst of the extension 101 by the finger not directly used for the bodily sensation, for example, the third finger.

(6) In the embodiment shown in FIG. 1 constitution, a portion for imparting the sound sensation by the auditory sensation is constituted by a headphone 210, and an electric signal to the headphone 210 is obtained from a further external output terminal 205A.

(7) The constitutional parts shown in FIGS. 4 and 5(a) are encased into a single box, and an independent power supply circuit is provided, which is mounted as an adapter on a stereo-audio set 200 as shown in FIG. 1 or a portable player.

(8) The constitutional parts shown in FIGS. 4 and 5(a) are integrally provided within the stereo-audio set 200 as shown in FIG. 1.

(9) In the embodiment shown in FIG. 3, with respect to a weight 101X for adjusting the vibrational amplitude at a position of the extension 101 on which is laid the fingertip 310, the weight 101X is slidably inserted along the extension 101 at a place not gripped by the hand 310, for example, the upper side or lower side, and a stopper 101V, for example, a screw —,—. is provided to secure the weight at a desired position on the extension 101.

Figure 8:
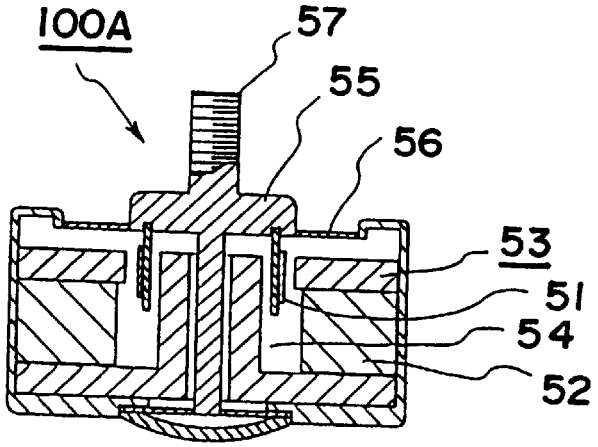
FIG. 8 PRIOR ART
FIGS. 8 and 9 are respectively sectional views showing the prior art device.

(10) The portion of the electric machine vibration converter 100 is changed to that of the first prior art as shown in FIG. 8. Further, the extension 101 is threaded and secured into a portion of a mount screw 57 in the construction shown in FIG. 8.

Figure 9:
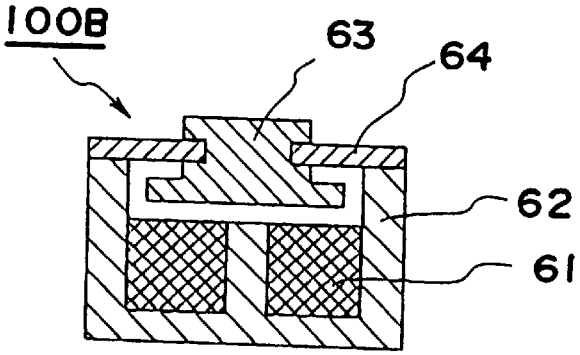
FIG. 9 PRIOR ART
Figure 10:
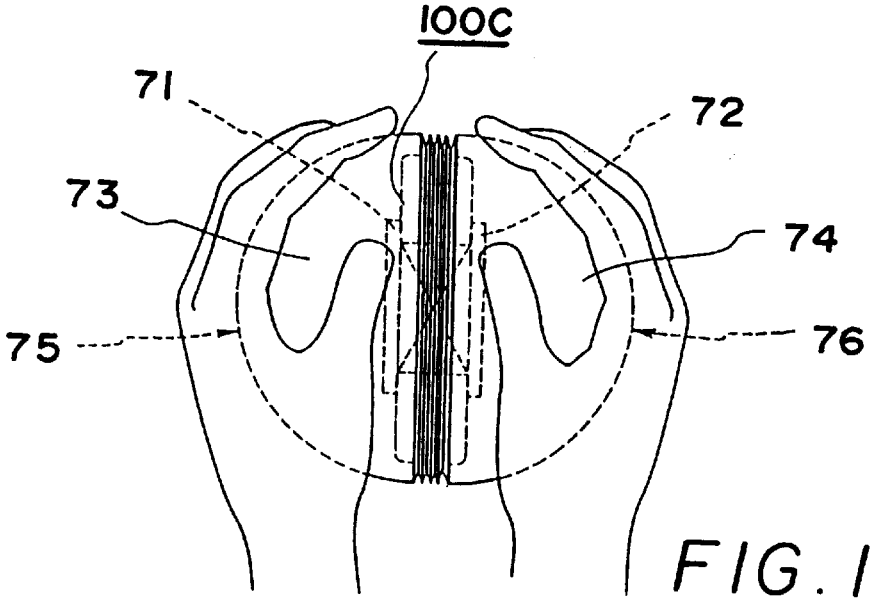
FIG. 10 PRIOR ART
FIG. 10 is a perspective view of a constitution of another prior art device.

(11) The portion of the electric machine vibration converter 100 is changed to that of the second prior art as shown in FIG. 9.

(12) As in the [embodiment shown] in FIG. 3, a protrusion 101B is provided at a position of the extension 101 pinched by the fingertips 301. This protrusion can be formed by a one-side protrusion 101B1 or a lump-like swelling portion 101B2. Further, in case of this constitution, the section of a portion except the protrusion 101B can be formed into a shape not having a convex curved surface, for example, a hexagonal shape.

Figure 3A:
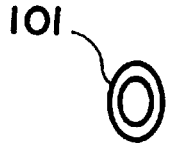
FIG. 3(A) is a cross section of one embodiment of an extension 101 according to the invention.

(13) The convex curved surface formed on the extension 101 is formed into a curved surface having different curvatures, for example, such as an oval as shown in FIG. 3(A) so that a place different in the curvature is pinched so as to obtain a different strength of the bodily sensation.

The construction according to the above-described [embodiments of the invention] may be summarized as follows. The constitutions in the above-described embodiments (1) and (2) provide a method for imparting the acoustic vibrational bodily sensation in which a part of the electric machine vibration converter 100, that is, vibrations obtained from the spacer 106 and the yoke 102 are directly transmitted to the fingertips 301 of the human body 300 to thereby impart the bodily sensation, and an apparatus for imparting the acoustic vibrational bodily sensation in which protrusions 121 and 122 are provided so that the fingertips 301 of the human body 300 are pushed against parts of the electric machine vibration converter 100, that is, the spacer 106 and the yoke 102.

In the constitution according to the above embodiments (4), there is an apparatus for imparting the acoustic vibrational bodily sensation in which the extension 101 is formed from a pole-like member in the form of a solid round rod having a diameter of 1 cm or less and a length of 20 cm or more, said pole-like member having an outer surface in the form of a convex curved surface by the outer surface of the round rod. In the constitution according to the above embodiment (9), there is an apparatus for imparting the acoustic vibrational bodily sensation which is provided with the weight 101X inserted in a manner capable of being slid and fixed lengthwise along the extension 101 for adjusting the amplitude at a place of the extension 101 on which is laid the fingertip 301.

In the constitution according to the above embodiments (12), there is an apparatus for imparting the acoustic vibrational bodily sensation in which the protrusion 101B against which the fingertip of the human being is directly pushed is provided on the extension 101 provided on the electric machine vibration converter.

INDUSTRIAL APPLICABILITY

In the invention, as described above, the fingertip is pushed against a part of the electric machine vibration converter or the convex curved surface or the protrusion provided on the extension to impart the bodily sensation. Therefore, these inventions enjoy the industrial utility value such that a sharp bodily sensation is obtained, and as a result, even if power of an electric signal is relatively small, a sufficiently great bodily sensation can be obtained.

Further, there can be enjoyed the industrial utility value such that the power of an electric signal can be decreased whereby it is possible to considerably reduce an unpleasant sensation caused by vibrational noises directly produced from the electric machine vibration converter and bodies such as a chair, a floor or the like on which the electric machine vibration converter is installed.

Furthermore, the contact of the human body with respect to the electric machine vibration converter or the extension thereof is detected by the contact detection circuit to intermittently control vibrations of the electric machine vibration converter. Therefore, the industrial utility value of the aforesaid invention is high in terms of the fact that an occurrence of unpleasant noises from a place for installation can be automatically prevented when not in use.

I claim:

1. An apparatus for imparting an acoustic vibrational sensation comprising:

a converter for converting acoustic frequencies of an electrical signal into mechanical vibrations;

a pole-shaped extension for transmitting the mechanical vibrations from the convertor along a length of the pole-shaped extension to a human hand grasping the pole-shaped extension, the pole-shaped extension being sized so as to be graspable by a single human hand lengthwise along the pole-shaped extension;

a contact detection circuit for producing a contact signal in response to contact of a human hand with the pole-shaped extension; and a switching circuit for causing the convertor to convert acoustic frequencies of an electrical signal into mechanical vibrations when the switching circuit receives the contact signal from the contact detection circuit, and for halting the convertor from converting acoustic frequencies of an electrical signal into mechanical vibrations when the switching circuit does not receive the contact signal from the contact detection circuit.

2. The apparatus for imparting an acoustic vibrational sensation according to claim 1, wherein at least a portion of the pole-shaped extension has a convex surface.

3. The apparatus for imparting an acoustic vibrational sensation according to claim 2, wherein the convex surface is oval shaped.

4. The apparatus for imparting an acoustic vibrational sensation according to claim 1, wherein the pole-shaped extension is sized to be graspable by a human hand such that both a fingertip of a thumb and a second joint portion of a forefinger of the human hand contact the pole-shaped extension at a distance from the convertor so as to impart a strong acoustic vibrational sensation to the fingertip of the thumb and the second joint portion of the forefinger.

5. The apparatus for imparting an acoustic vibrational sensation according to claim 1, wherein the pole-shaped extension is one of the group of a solid metal rod, a metal pipe, or a synthetic resin.

6. The apparatus for imparting an acoustic vibrational sensation according to claim 1, wherein the pole-shaped extension has a diameter of 1 cm or less and a length of 20 cm or less.

7. The apparatus for imparting an acoustic vibrational sensation according to claim 1, further including a switching circuit for causing the convertor to convert acoustic frequencies of an electrical signal into mechanical vibrations when the switching circuit is manually switched, and for halting the convertor from converting acoustic frequencies of an electrical signal into mechanical vibrations when the switching is not manually switched.

8. An apparatus for imparting an acoustic vibrational sensation comprising:

a converter for converting acoustic frequencies of an electrical signal into mechanical vibrations; and a pole-shaped extension for transmitting the mechanical vibrations from the convertor along a length of the pole-shaped extension to a human hand grasping the pole-shaped extension, the pole-shaped extension being sized so as to be graspable by a single human hand lengthwise along the pole-shaped extension and including a mark at a position along a length of the pole-shaped extension at which position a strong acoustic vibrational sensation is imparted to a fingertip of a human hand pressing against the mark.

9. An apparatus for imparting an acoustic vibrational sensation comprising:

a converter for converting acoustic frequencies of an electrical signal into mechanical vibrations;

a pole-shaped extension for transmitting the mechanical vibrations from the convertor along a length of the pole-shaped extension to a human hand grasping the pole-shaped extension, the pole-shaped extension being sized so as to be graspable by a single human hand lengthwise along the pole-shaped extension; and a weight slidably mounted on the pole-shaped extension, such that the weight is movable along a length of the pole-shaped extension to adjust an amplitude of the mechanical vibrations transmitted by the pole-shaped extension.

* * * * *